US007976015B2

(12) United States Patent
Kobayashi

(10) Patent No.: US 7,976,015 B2
(45) Date of Patent: Jul. 12, 2011

(54) FEED DEVICE AND RECORDING DEVICE WITH GATE MEMBER

(75) Inventor: Satoshi Kobayashi, Kitakyusyu (JP)

(73) Assignee: Seiko Epson Corporation, Tokyo (JP)

( * ) Notice: Subject to any disclaimer, the term of this patent is extended or adjusted under 35 U.S.C. 154(b) by 57 days.

(21) Appl. No.: 12/543,680

(22) Filed: Aug. 19, 2009

(65) Prior Publication Data

US 2010/0044954 A1 Feb. 25, 2010

(30) Foreign Application Priority Data

Aug. 20, 2008 (JP) ..... 2008-211654

(51) Int. Cl.
*B65H 3/52* (2006.01)

(52) U.S. Cl. ..... 271/121; 271/124

(58) Field of Classification Search ..... 271/121, 271/123, 124, 167, 169, 127
See application file for complete search history.

(56) References Cited

U.S. PATENT DOCUMENTS

| | | | | |
|---|---|---|---|---|
| 6,010,126 | A * | 1/2000 | Mou et al. | 271/121 |
| 7,111,934 | B2 * | 9/2006 | Okuda et al. | 347/104 |
| 7,392,979 | B2 * | 7/2008 | Sasaki et al. | 271/120 |
| 7,407,158 | B2 * | 8/2008 | Ogaya et al. | 271/124 |
| 7,410,161 | B2 * | 8/2008 | Yamamoto | 271/124 |
| 7,607,656 | B2 * | 10/2009 | Yoshida | 271/121 |
| 7,703,763 | B2 * | 4/2010 | Shiohara et al. | 271/145 |
| 2010/0025922 | A1 * | 2/2010 | Kobayashi | 271/121 |
| 2010/0052236 | A1 * | 3/2010 | Kobayashi | 271/3.08 |

FOREIGN PATENT DOCUMENTS

| | | | |
|---|---|---|---|
| JP | 05254672 | A * | 10/1993 |
| JP | 08-091612 | | 4/1996 |
| JP | 2009-001366 | | 1/2009 |

* cited by examiner

*Primary Examiner* — Jeremy Severson
(74) *Attorney, Agent, or Firm* — Workman Nydegger

(57) ABSTRACT

Provided is a feed device including: a loading unit in which a plurality of sheet members is loaded in a stacked state; a delivery member which performs a feed operation in a state in which a contact surface thereof is in contact with an uppermost sheet member of the sheet members loaded on the loading unit and delivers the sheet member in a feed direction using friction force with the uppermost sheet member as the feeding force; a gate member which is configured to move in a direction to and from the contact surface of the delivery member and has an inclined surface with which a front end of the sheet member delivered by the delivery member collides with; and a gate energizing member which energizes the gate member in a direction approaching to the contact surface of the delivery member.

7 Claims, 7 Drawing Sheets

FEED DEVICE AND RECORDING DEVICE WITH GATE MEMBER

BACKGROUND

1. Technical Field

The present invention relates to a feed device such as a paper feed device and a recording device such as an ink jet printer including the feed device.

2. Related Art

A known recording device such as a printer includes a paper feed device (feed device) for automatically feeding paper to a location facing a recording head (recording unit) while separating a plurality of sheets of paper loaded one by one in a stacked state so as to continuously perform recording with respect to the plurality of sheets of paper (sheet members) (for example, JP-A-8-91612).

The feed device of JP-A-8-91612 includes a paper feed cassette (loading unit) in which a plurality of sheets of paper is loaded in a stacked state, a paper feed roller (delivery member) which rotates while in contact with the uppermost sheet of paper out of the sheets loaded in the stacked state and delivers the uppermost sheet in a feed direction using frictional force with the uppermost paper, and a gate member for preventing double feed of the uppermost sheet of paper and the underlying sheet of paper in the feed direction.

In detail, this gate member is configured such that one end side thereof is oscillatorily supported as a fulcrum and the other end side thereof is in contact with the outer circumferential surface of the paper feed roller due to the energizing force of a predetermined compression spring. In addition, an inclined surface is provided in the other end side of the gate member at a location so that the front end of the paper continuously delivered by the paper feed roller may collide therewith. If the front end of the paper delivered by the paper feed roller in the feed direction collides with the inclined surface, the gate member of which the inclined surface is pressed by the paper oscillates against the energizing force of the compression spring in a direction separating from the outer circumferential surface of the paper feed roller and thus a gap is formed through which only a single sheet of paper passes between the paper feed roller and the gate member. Accordingly, only the uppermost sheet of paper is fed through the gap in the feed direction. At this time, if the uppermost sheet of paper and the underlying sheet of paper are double fed by friction force therebetween, the double feed of the sheet of paper underlying the uppermost sheet of paper is prevented by the inclined surface of the gate member.

However, in the paper feed device of JP-A-8-91612, if the friction force generated between the uppermost sheet of paper and the underlying sheet of paper is increased due to variation in the surrounding environment (temperature, humidity or the like), the underlying sheet of paper may be double fed over the inclined surface of the gate member when the uppermost sheet of paper is fed.

SUMMARY

An advantage of some aspects of the invention is that it provides a feed device and a recording device capable of efficiently suppressing double feed of the sheet member underlying an uppermost sheet member when the uppermost sheet member is fed from sheet members loaded in a stacked state.

According to an aspect of the invention, there is provided a feed device including: a loading unit in which a plurality of sheet members is loaded in a stacked state; a delivery member which performs a feed operation in a state in which a contact surface thereof is in contact with an uppermost sheet member of the sheet members loaded on the loading unit and delivers the sheet member in a feed direction using friction force with the uppermost sheet member as the feeding force; a gate member which is configured to move in a direction to and from the contact surface of the delivery member and has an inclined surface with which the front end of the sheet member delivered by the delivery member collides with; and a gate energizing member which energizes the gate member in a direction approaching the contact surface of the delivery member, wherein, the uppermost sheet member is delivered by the delivery member such that the front end thereof collides with the inclined surface of the gate member, and a gap is formed through which only the uppermost sheet member passes between the delivery member and the gate member by moving the gate member against energizing force of the gate energizing member in the direction separating it from the delivery member, and wherein a pressing force applying unit is included which applies a pressing force along the stacked direction of the sheet members at an upstream side of the inclined surface on the feed path of the sheet members to the sheet member underlying the uppermost sheet member over the uppermost sheet member after a portion of the uppermost sheet member passes through the gap.

By this configuration, when the uppermost sheet member of the sheet members loaded in the stacked state is fed, after a portion of the uppermost sheet member passes through the gap, the pressing force applying unit applies the pressing force along the stacked direction of the sheet members to the sheet member underlying the uppermost sheet over the uppermost sheet member at the upstream side of the inclined surface on the feed path of the sheet members. Therefore, since it will be harder for the sheet member underlying the uppermost sheet member to get over the inclined surface due to the pressing force of the pressing force applying unit, it is possible to easily separate the uppermost sheet member and the sheet member underlying the uppermost sheet member. As a result, when the uppermost sheet member is fed, it is possible to efficiently suppress the double feed of the sheet member underlying the uppermost sheet member.

In the feed device of the invention, the pressing force applying unit may include a displacement member which is displaced between a pressing position where the sheet member underlying the uppermost sheet member is pressed and a non-pressing position where the sheet member is not pressed.

By this configuration, when the uppermost sheet member is fed, after the portion of the uppermost sheet member passes through the gap, the displacement member is displaced from the non-pressing position to the pressing position, such that the double feed of the sheet member underlying the uppermost sheet member can be efficiently suppressed.

In the feed device of the invention, the displacement member may include a rotary member which is rotated and displaced between the pressing position and the non-pressing position.

By this configuration, since the displacement member includes the rotary member, it is possible to reduce the space necessary for displacing the displacement member between the pressing position and the non-pressing position, compared with the case where the displacement member includes a member which is linearly reciprocated between the pressing position and the non-pressing position.

In the feed device of the invention, the rotary member may include a first arm engaged with the sheet member at a downstream side of the inclined surface on the feed path of the sheet member at the non-pressing position, and a second arm applying pressing force at the pressing position to the sheet member underlying the uppermost sheet member before feeding.

By this configuration, the rotary member is rotated and displaced from the non-pressing position to the pressing position by the engagement of the uppermost sheet member and the first arm such that the pressing force can be applied by the second arm to the sheet member underlying the uppermost sheet member before feeding.

The feed device of the invention may further include an energizing member for energizing the rotary member to the non-pressing position, and, when a portion of the uppermost sheet member is engaged with the first arm, the rotary member may be rotated and displaced against the energizing force of the energizing member from the non-pressing position to the pressing position.

By this configuration, when the portion of the uppermost sheet paper is engaged with the first arm, it is possible to rotate and displace the rotary member from the non-pressing position to the pressing position against the energizing force of the energizing member. In addition, when the uppermost sheet paper is not engaged with the first arm, it is possible to rotate and displace the rotary member from the pressing position to the non-pressing position by the energizing force of the energizing member.

In the feed device of the invention, the roller, which is rotated by the feeding of the sheet member, may be provided on at least one of the contact portion of the first arm with the sheet member and the contact portion of the second arm with the sheet member.

By this configuration, when the sheet member is fed, even when either the first arm and the second arm is brought into contact with the sheet member, it is possible to reduce the friction resistance force applied from either the first arm and the second arm to the sheet member, by rotating the roller which is in contact with the sheet member. Thus, it is possible to smoothly feed the sheet member.

According to another aspect of the invention, there is provided a recording device including: the feed device according to claim 1; and a recording unit which performs a recording process with respect to the sheet member fed by the feed device.

By this configuration, the same effects as described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer (hereinafter, referred to as a "printer") which is implemented as a recording device of the invention will be described with reference to the accompanying drawings. In the following description, terms "front-and-rear direction", "left-and-right direction" and "up-and-down direction" respectively indicate directions denoted by arrows of the drawings.

Figure 1:
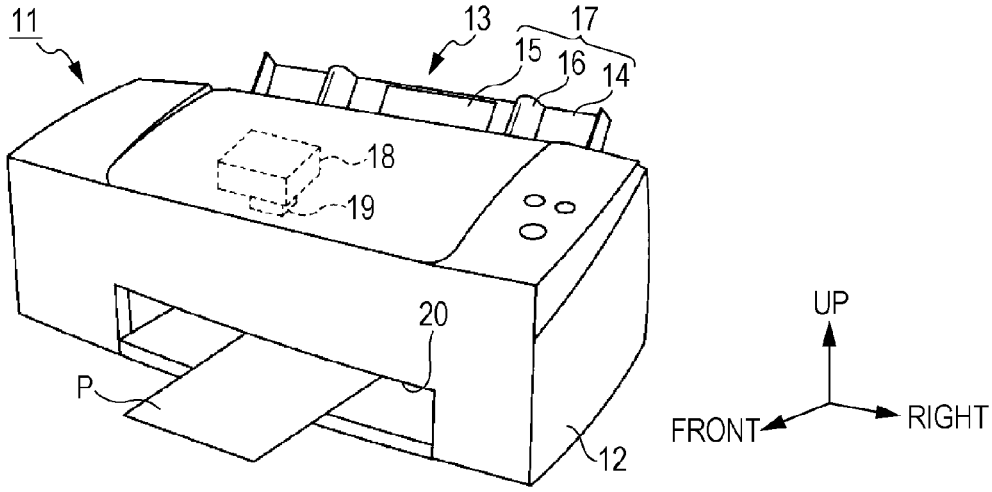
FIG. 1 is a perspective view of an ink jet printer according to an embodiment of the invention.

As shown in FIG. 1, the printer 11 functioning as the recording device includes a main body 12 having a substantially rectangular parallelepiped shape. An auto paper feed device 13, which functions as a feed device for feeding paper P as a sheet member, is mounted on a rear surface of the main body 12. The auto paper feed device 13 includes a paper guide 17 functioning as a loading unit and having a paper feed tray 14, a hopper 15 and an edge guide 16, and a paper feed driving mechanism (not shown) for feeding one by one a plurality of sheets of paper P loaded in the paper guide 17 in a stacked state into the main body 12.

A carriage 18 reciprocally moving in the main scan direction (the left-and-right direction of FIG. 1) is provided in the main body 12, and a recording head 19 functioning as a recording unit is provided under the carriage 18. Printing (recording) onto paper P is performed by alternately repeating a recording operation for ejecting ink from the recording head 19 onto paper P while the carriage 18 moves in the main scan direction and a feed operation for feeding the paper P in the sub scan direction (a front direction) in a predetermined feed amount. In addition, the printed paper P is ejected from an ejection port 20 formed in the lower side of the front surface of the main body 12.

Figure 2:
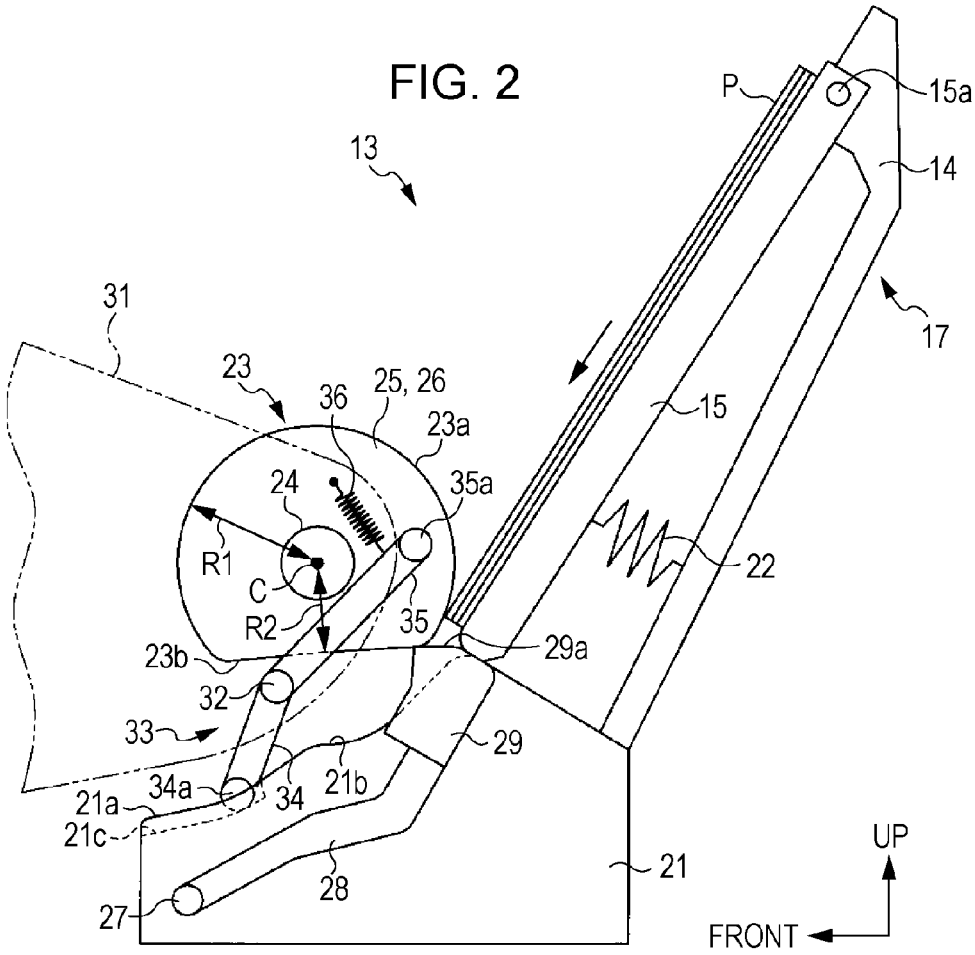
FIG. 2 is a schematic side view showing a state in which a rotary member is located at a non-pressing position, in an auto feed device according to the embodiment of the invention.
Figure 3:
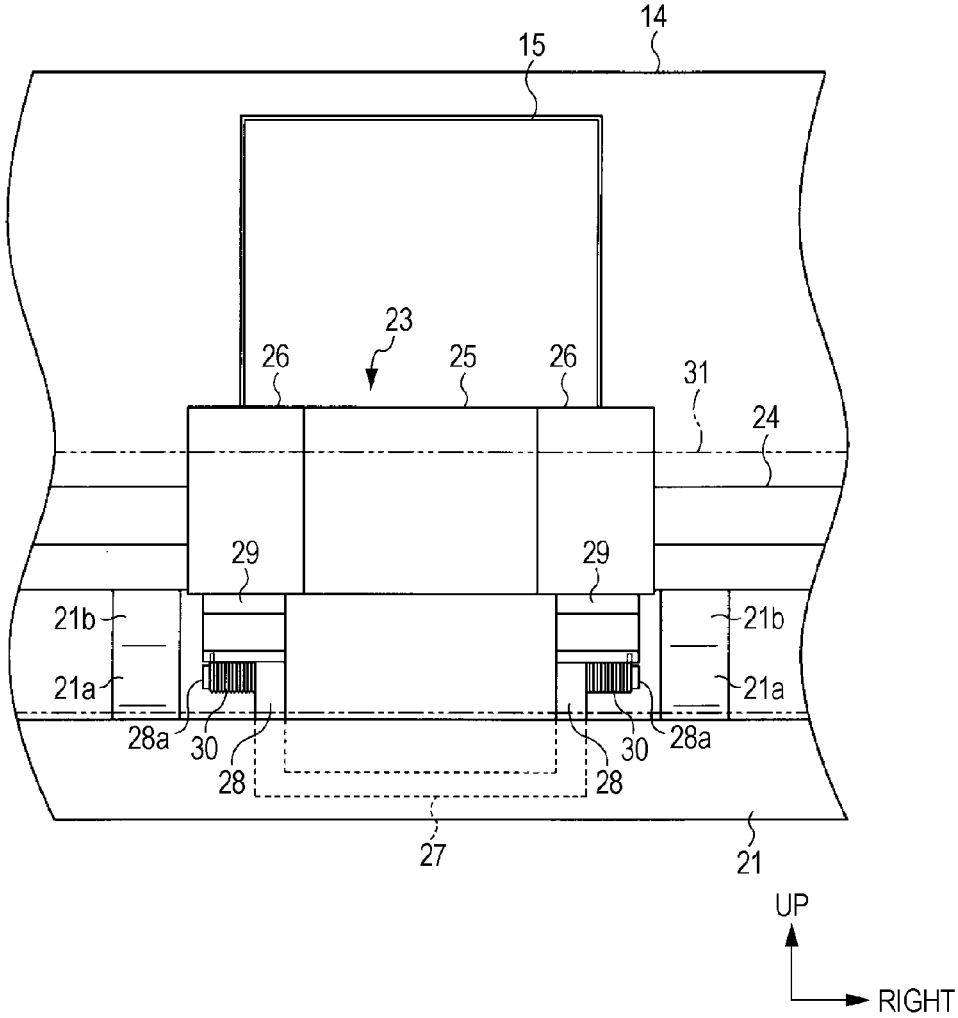
FIG. 3 is a schematic enlarged front view of main portions of the auto feed device according to the embodiment of the invention.

As shown in FIGS. 2 and 3, the lower end side of the paper feed tray 14 obliquely disposed on the rear surface of the main body 12 (see FIG. 1) of the auto paper feed device 13 is supported by the rear side of a base portion 21 disposed in the main body 12, and the hopper 15 is provided on the central portion in the left-and-right direction of the upper surface of the paper feed tray 14. A compression spring 22 is interposed between the lower end side of the hopper 15 and the paper feed tray 14. The hopper 15 is configured so as to be able to rotate around a shaft 15*a* provided at the upper end side thereof between a paper feed position shown in FIG. 2 and a retreated position (see FIG. 4) in which the compression spring 22 is more compressed than in the state shown in FIG. 2 and the lower end side of the hopper 15 is rotated in a counter-clockwise direction. In FIG. 3, for the sake of understanding the drawing, the paper P is not shown.

At the front side in the vicinity of the lower end of the hopper 15 located at the paper feed position, a paper feed roller 23, which functions as a delivery member and has a substantially D-shape in a side view, is supported on a rotary shaft 24 which extends in the left-and-right direction and is provided in the main body 12 (see FIG. 1) so that it is able to rotate. The paper feed roller 23 includes a delivery portion 25 formed by covering an outer circumferential surface of a core made of hard plastic with rubber, and separation portions 26 made of hard plastic and integrally formed on the left and right sides of the delivery portion 25.

The width of the delivery portion 25 in the left-and-right direction is larger than that of the separation portions 26, and the outer circumferential surface of the delivery portion 25 and the outer circumferential surfaces of the separation portions 26 are flush with each other. The paper feed roller 23 is rotated by rotary driving of the rotary shaft 24 so as to perform the feed operation of the paper P. The outer circumferential surface of the paper feed roller 23 includes a circumferential surface 23*a* which is a contact surface having a radius of a distance R1 from an axial center C of the rotary shaft 24 and a flat surface 23*b* separating from the axial center C of the rotary shaft 24 by a distance R2, and the distance R1 is set to be larger than the distance R2.

That is, the distances R1 and R2 are set such that the circumferential surface 23*a* is brought into contact with the paper P and the flat surface 23*b* is not brought into contact with the paper P, when the paper feed roller 23 is rotated in a state in which the hopper 15 is disposed at the paper feed position. In a state in which the circumferential surface 23*a* is brought into contact with the paper P, the paper P is pressed into contact with the circumferential surface 23*a* by the energizing force of the compression spring 22.

The friction force with the paper P, when the paper feed roller 23 is rotated in a state in which the circumferential surface 23*a* of the delivery portion 25 and the paper P are in contact with each other, is set to be larger than the friction force between the stacked sheets of paper P. In contrast, the friction force with the paper P, when the paper feed roller 23 is rotated in a state in which the circumferential surface 23*a* of each of the separation portions 26 and the paper P are in contact with each other, is set to be smaller than the friction force between the stacked sheets of paper P.

Accordingly, when the paper feed roller 23 is rotated in a state of being in contact with the paper P, the energizing force of the compression spring 22 becomes a vertical resisting force and the friction force generated between the circumferential surface 23*a* of the delivery portion 25 and the paper P becomes the feeding force, such that the paper P is delivered by the delivery portion 25. In this case, since the friction force generated between the circumferential surface 23*a* of each of the separation portions 26 and the paper P is smaller than the friction force generated between the sheets of paper P, the feeding force for delivering the paper P is not generated in the separation portions 26.

As shown in FIGS. 2 and 3, guides 21*a* obliquely extending forward and downward are formed on the front side of the base portion 21 at positions which become the outsides of the paper feed roller 23 in the left-and-right direction. A bank 21*b* (see FIG. 2) having a gentle projecting shape in a side view is formed in the vicinity of the center of the front-and-rear direction of each of the guides 21*a*.

Arm members 28, which are supported so that they can oscillate by the base portion 21 with an axial portion 27 whose lower end side extends in the left-and-right direction, are obliquely disposed at positions corresponding to both the separation portions 26 in the insides of both the guides 21*a* in the base portion 21, and gate members 29 are attached to the upper end sides of both the arm members 28 so as to individually correspond to both the separation portions 26. In the gate members 29, inclined surfaces 29*a* are formed which protrude higher than the guides 21*a* in the base portion 21 such that the paper P delivered from the paper feed tray 14 collides therewith at a predetermined angle.

Torsion coil springs 30 are mounted on convex portions 28*a* extending outward in the vicinities of the upper ends of the arm members 28. One end of each of the torsion coil springs 30 is locked to a locking portion (not shown) provided in the base portion 21 and the other end thereof is locked to a locking portion (not shown) provided in each of the gate members 29.

The gate members 29 are not in contact with the separation portions 26 when facing the vicinities of the centers of the flat surface 23*b* of the separation portions 26 in the paper feed roller 23, but are rotated in a clockwise direction of FIG. 2 around the axial portion 27 and are in contact with the circumferential surface 23*a* of the separation portions 26 when facing the circumferential surface 23*a* of the separation portions 26. When the gate members 29 are in contact with the circumferential surface 23*a* of the separation portions 26, the torsion coil springs 30 are energized in a direction in which the gate members 29 approach the circumferential surface 23*a* of the separation portions 26.

When the paper P is fed, as shown in FIG. 2, the separation portions 26 of the paper feed roller 23 are brought into contact with the gate members 29 and the hopper 15 is then moved from the retreated position to the paper feed position. When the paper P is delivered in the feed direction denoted by the arrow of FIG. 2 by the rotated paper feed roller 23, the front end of the uppermost sheet of paper P collides with the inclined surfaces 29*a* of the gate members 29.

At this time, the gate members 29 are moved from the state of FIG. 2 to positions contacting with the circumferential surface 23*a* of the separation portions 26, but are moved in a direction (the clockwise direction of FIG. 2) separating them from the circumferential surface 23*a* of the separation portions 26 against the energizing force of the torsion coil springs 30 by a distance corresponding to the thickness of the uppermost sheet of paper P, by the pressing force when the uppermost sheet of paper P collides with the inclined surfaces 29*a*.

That is, when the uppermost sheet of paper P delivered by the delivery portion 25 of the paper feed roller 23 collides with the inclined surfaces 29*a*, the contact angle between the inclined surfaces 29*a* and the paper P or the energizing force of the torsion coil springs 30 is set such that a gap, through which only a single sheet of paper P can pass, is formed between the separation portions 26 of the paper feed roller 23 and the gate members 29.

Meanwhile, the paper P underlying the uppermost sheet of paper P does not have a feeding force capable of moving the gate members 29 against the energizing force of the torsion coil springs 30 when colliding with the inclined surfaces 29*a* of the gate members 29. Accordingly, even when the underlying sheet of paper P is pulled along with the uppermost sheet of paper P delivered by the delivery portion 25 of the paper feed roller 23 by the friction force, the underlying sheet of paper P is prevented from being fed due to the collision with the inclined surfaces 29*a* of the gate members 29 and thus is separated from the uppermost sheet of paper P.

As shown in FIG. 2, an overhang portion 31, which overhangs so as to face the base portion 21 and the paper feed roller 23, is provided above the base portion 21 in the main body 12 (see FIG. 1). A gap is formed between the overhang portion 31 and both the guides 21*a* of the base portion 21, and the gap forms a portion of the feed path of the paper P. A shaft 32 extending in the left-and-right direction is fixed at a position facing the bank 21*b* of the right guide 21*a* below the overhang portion 31.

A rotary member 33, which is a displacement member functioning as a pressing force applying unit, is supported on the shaft 32 so as to be rotated around the shaft 32. The rotary member 33 includes a first arm 34 extending from the shaft 32 toward the front oblique lower side thereof and a second arm 35 extending from the shaft 32 toward the rear oblique upper side thereof, and the length of the first arm 34 is shorter than that of the second arm 35. One end of the first arm 34 and one end of the second arm 35 are connected to each other in a support portion of the shaft 32, and the angle between the first arm 34 and the second arm 35 is always constantly maintained.

A roller 34*a*, which rotates around an axial line extending in the left-and-right direction, is pivotably supported on the front end (lower end) of the first arm 34, and approximately half of the roller 34*a* is inserted into a concave portion 21*c* provided at the front side of the right guide 21*a*. Accordingly, the first arm 34 can be engaged with the paper P fed at the downstream side of the inclined surfaces 29*a* of the gate members 29 on the feed path of the paper P.

Meanwhile, a roller 35*a*, which rotates around an axial line extending in the left-and-right direction, is pivotably supported on the front end (upper end) of the second arm 35, and the roller 35*a* faces the lower end of the paper P loaded in the paper guide 17 in the stacked state before feeding. One end of a coil spring 36 functioning as an energizing member is attached to the upper surface of the front end of the second arm 35, and the other end of the coil spring 36 is fitted into the overhang portion 31.

The rotary member 33 is rotated and displaced between a non-pressing position (position shown in FIG. 2) in which the roller 35*a* of the second arm 35 does not press the lower end of the paper P loaded in the paper guide 17 in the stacked state before feeding and a pressing position (position shown in FIG. 8) in which the first arm 34 is engaged with the paper P fed along the guides 21*a* and is rotated in the clockwise direction around the shaft 32 from the non-pressing position against the energizing force of the coil spring 36 such that the roller 35*a* of the second arm 35 presses the lower end of the paper P loaded in the paper guide 17 in the stacked state before feeding along the stacked direction of the paper P.

Next, the operation of the auto paper feed device 13 having the above-described configuration will be described with reference to FIGS. 4 to 8.

Figure 4:
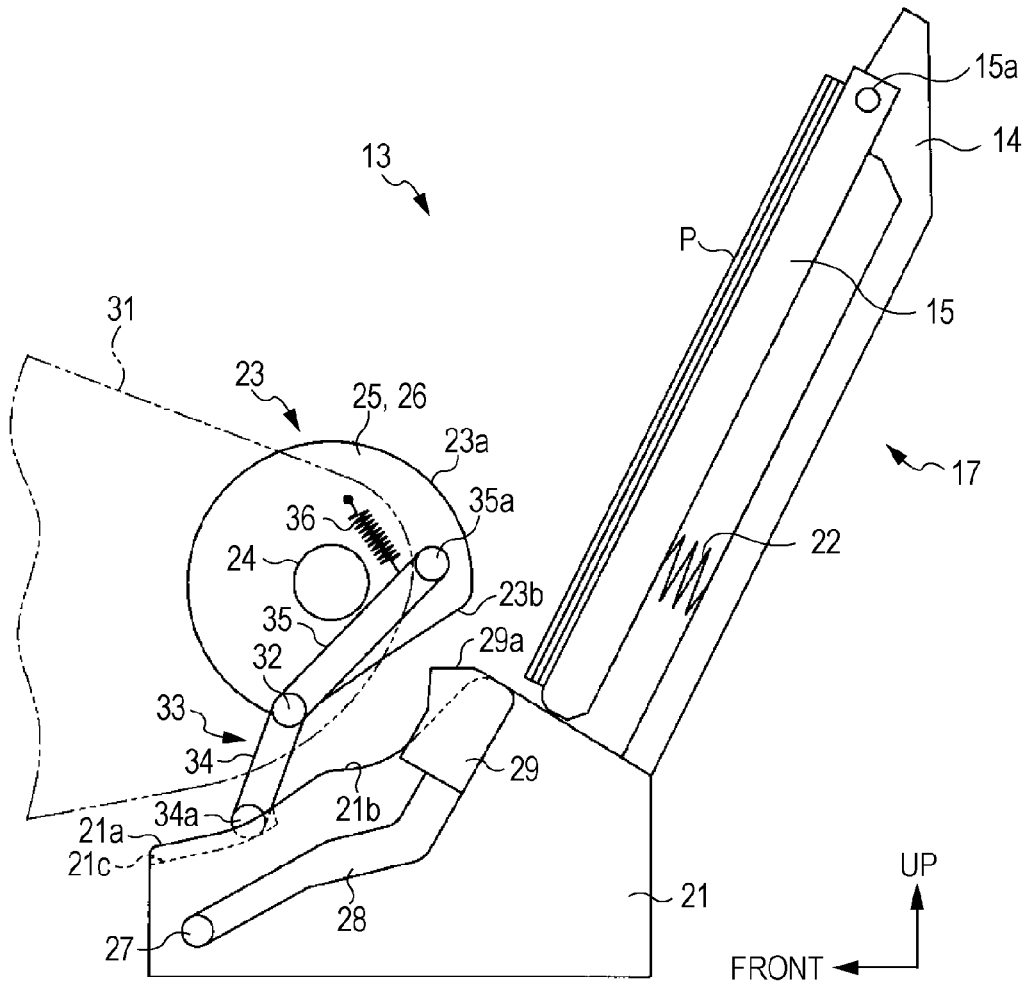
FIG. 4 is a schematic side view showing a reset state in the auto feed device according to the embodiment of the invention.

In a reset state shown in FIG. 4, the separation portions 26 of the paper feed roller 23 face the gate members 29 in the vicinity of the center of the flat surface 23*b*, and the hopper 15 is located at the retreated position separated from the delivery portion 25 of the paper feed roller 23. In addition, the rotary member 33 is located at the non-pressing position.

Figure 5:
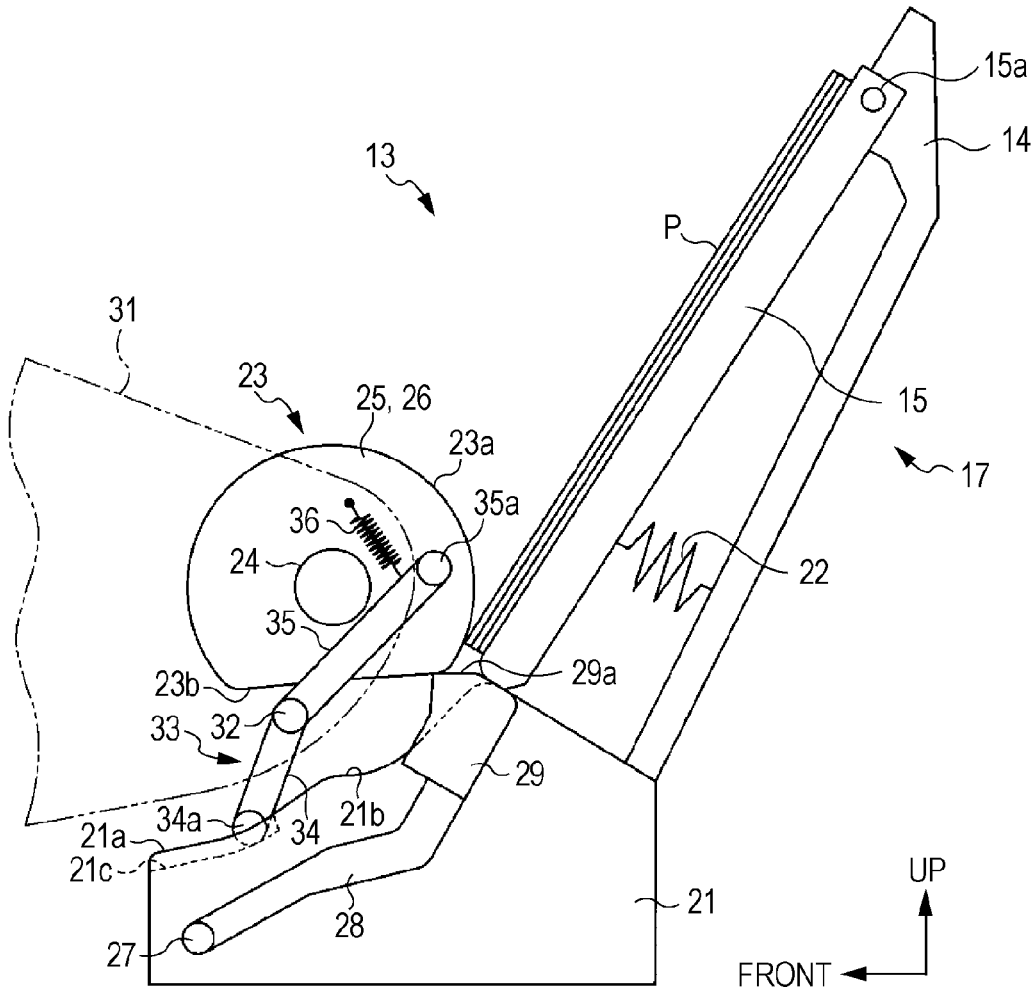
FIG. 5 is a schematic side view showing a state when paper is delivered, in the auto feed device according to the embodiment of the invention.

When the rotation of the rotary shaft 24 is started and the paper feed roller 23 is rotated in the clockwise direction of FIG. 4, as shown in FIG. 5, the separation portions 26 of the paper feed roller 23 are brought into contact with the gate members 29. When the separation portions 26 are brought into contact with the gate members 29, the hopper 15 is moved from the retreated position to the paper feed position and the uppermost sheet of paper P is brought into contact with the circumferential surface 23*a* of the delivery portion 25. When the paper feed roller 23 is continuously rotated, the front end of the uppermost sheet of paper P delivered by the delivery portion 25 collides with the inclined surfaces 29*a* of the gate members 29.

Figure 6:
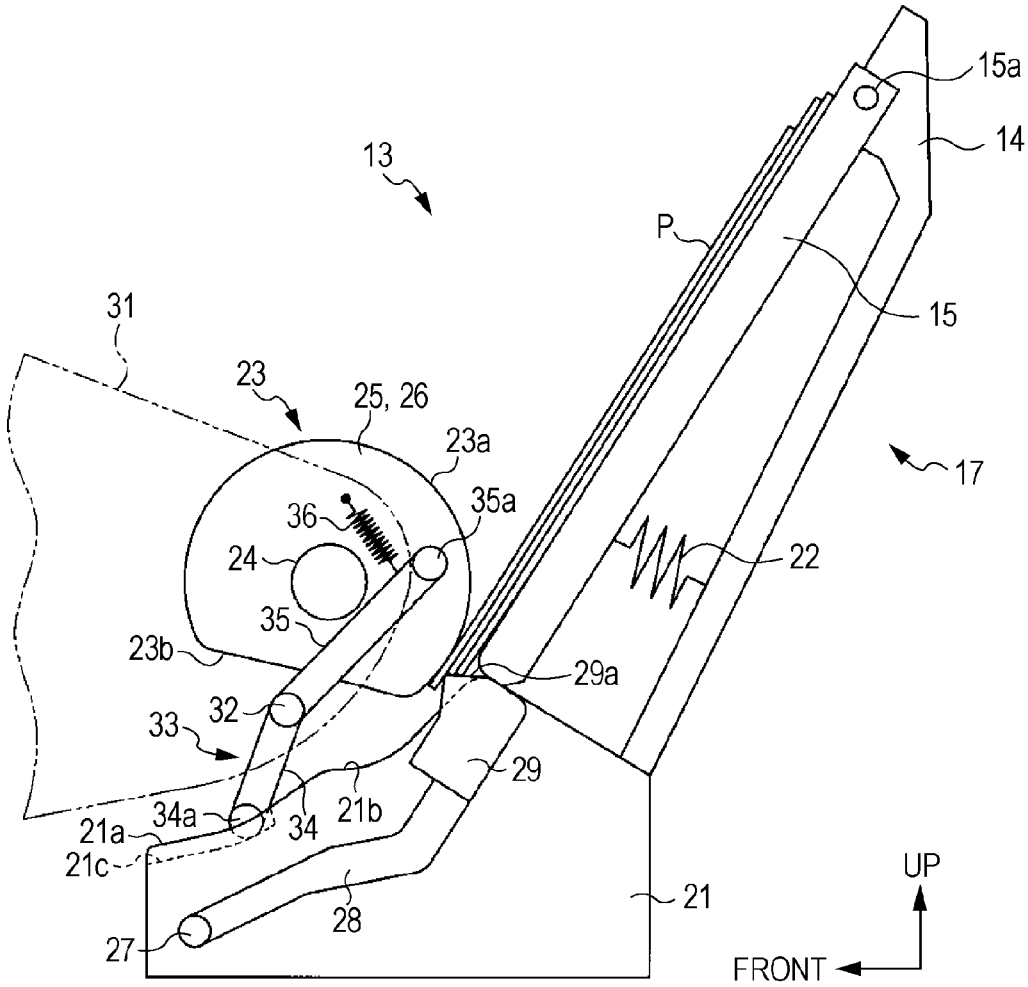
FIG. 6 is a schematic side view showing a state when paper is separated, in the auto feed device according to the embodiment of the invention.

Then, as shown in FIG. 6, the gate members 29 are moved against the energizing force of the torsion coil spring 30 in a direction (clockwise direction of FIG. 6) separating them from the circumferential surface 23*a* of the separation portions 26, a gap is formed through which only the uppermost sheet of paper P can pass between the circumferential surface 23*a* of the separation portions 26 and the gate members 29, and the front end of the uppermost sheet of paper P passes through this gap. At this time, the underlying sheet of paper P is begin pushed so as to be delivered together with the uppermost sheet of paper P due to the friction force generated between the sheets of paper P, but the underlying sheet of paper P is prevented from being fed by the collision with the inclined surfaces 29*a* of the gate members 29 and is separated from the uppermost sheet of paper P.

Figure 7:
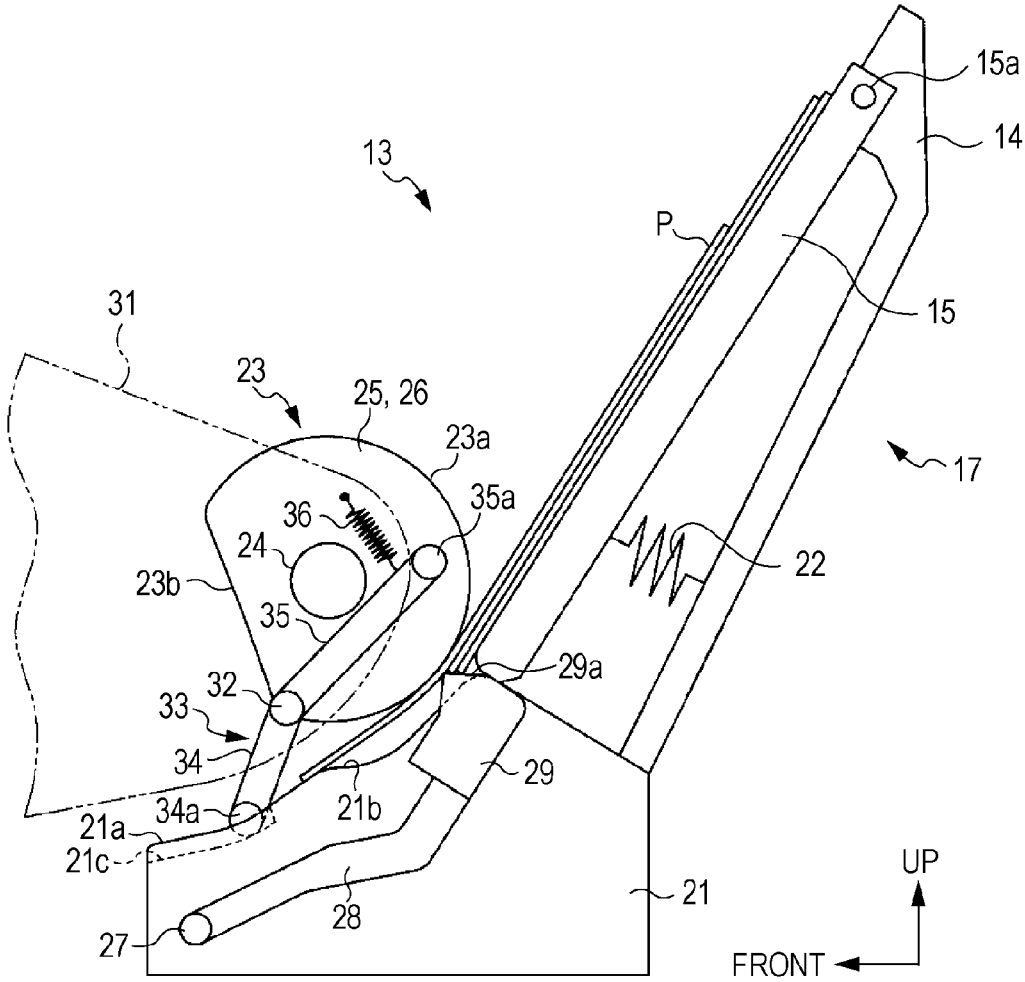
FIG. 7 is a schematic side view showing a state in the midway of feeding paper in the auto feed device according to the embodiment of the invention.
Figure 8:
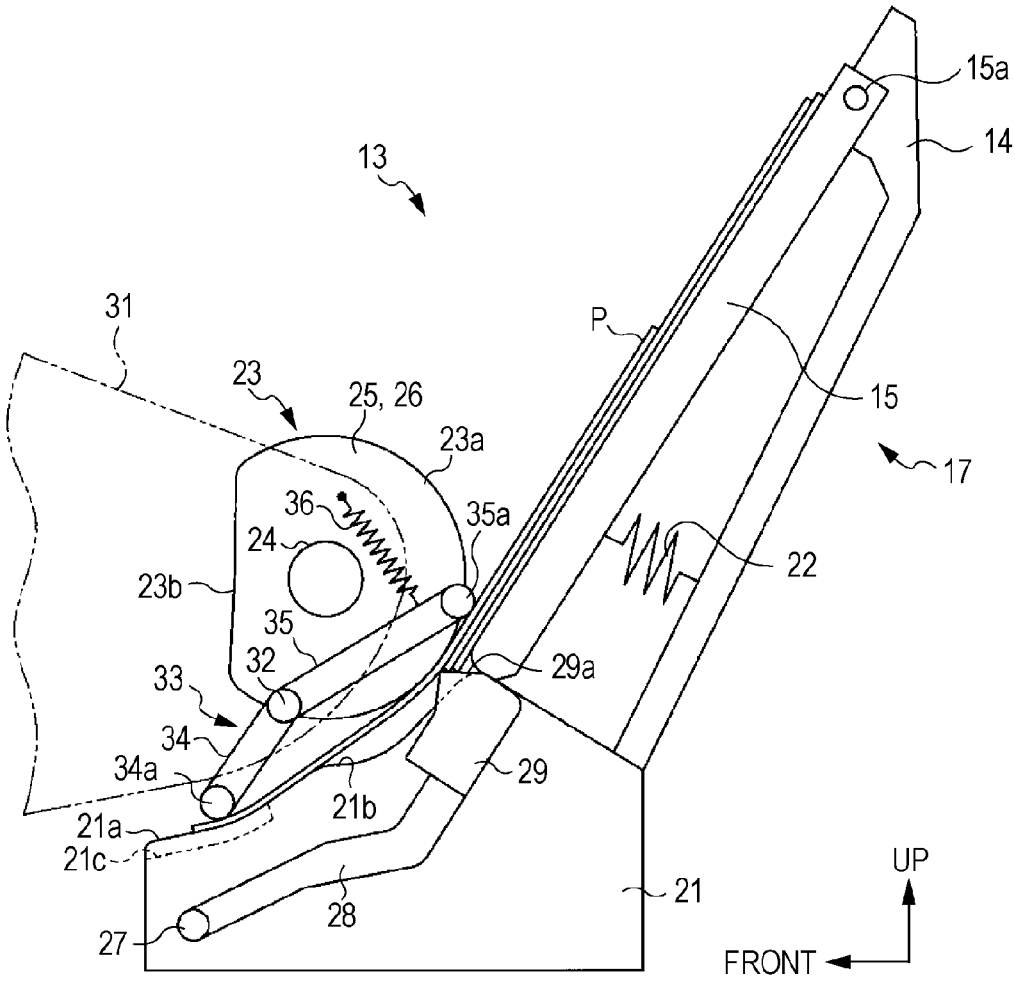
FIG. 8 is a schematic side view showing a state, in which a rotary member is rotated and displaced at a pressing position, in the auto feed device according to the embodiment of the invention.

When the paper feed roller 23 is continuously rotated, as shown in FIG. 7, the front end of the uppermost sheet of paper P, which passes through the gap between the circumferential surface 23*a* of the separation portions 26 and the gate members 29, reaches the bank 21*b* of the base portion 21. When the paper feed roller 23 is rotated, the front end of the uppermost sheet of paper P is engaged with the first arm 34 so as to press the first arm 34 forward, as shown in FIG. 8.

Then, since the front end of the uppermost sheet of paper P slides between the concave portion 21*c* of the guide 21*a* and the roller 34*a* of the first arm 34 due to the rotating the roller 34*a*, the first arm 34 is pushed up by the uppermost sheet of paper P. Accordingly, the rotary member 33 is rotated around the shaft 32 in the clockwise direction of FIG. 8 against the energizing force of the coil spring 36, and is rotated and displaced from the non-pressing position to the pressing position. Thus, the roller 35*a* of the second arm 35 presses the lower end of the paper P underlying the uppermost sheet of paper P loaded in the paper guide 17 in the stacked state over the uppermost sheet of paper P along the stacked direction of the paper P.

That is, since the paper P underlying the uppermost sheet of paper P is pressed by the roller 35*a* of the second arm 35 at the upstream side of the inclined surfaces 29*a* of the gate members 29 on the feed path of the paper P, it is even harder for the underlying sheet of paper P to get over the inclined surfaces 29*a* and thus the underlying sheet of paper P is properly prevented from being fed (double fed) together with the uppermost sheet of paper P. At this time, since the rotary member 33 is in contact with the uppermost sheet of paper P in the roller 34*a* of the first arm 34 and the roller 35*a* of the second arm 35, both the rollers 34*a* and 35*a* are rotated by the feed of the uppermost sheet of paper P. Accordingly, since friction resistance, which is applied from the rotary member 33 in which the uppermost sheet of paper P is located at the pressing position when the uppermost sheet of paper P is fed, is reduced, the smooth feeding state of the uppermost sheet of paper P is maintained.

Thereafter, the uppermost sheet of paper P is fed to the recording head 19 by the feeding force based on the rotation of the paper feed roller 23. When the uppermost sheet of paper P is fed to the recording head 19 such that the uppermost sheet of paper P and the roller 34*a* of the first arm 34 are separated from each other, the rotary member 33 is rotated and displaced from the pressing position to the non-pressing position by the energizing force of the coil spring 36.

According to the above-described embodiment, the following effects can be obtained.

(1) In the auto feed device 13, when the uppermost sheet of paper P is fed from the sheets of paper P loaded in the stacked state, the rotary member 33 is rotated and displaced from the non-pressing position to the pressing position by the engagement between the uppermost sheet of paper P and the first arm 34 after the front end of the uppermost sheet of paper P passes through the gap between the circumferential surface 23*a* of the separation portions 26 of the paper feed roller 23 and the gate members 29. Thus, it is possible to apply the pressing force along the stacked direction of the sheets of paper P to the paper P underlying the uppermost sheet of paper P over the uppermost sheet of paper P by the second arm 35. Therefore, since it is hard for the paper P underlying the uppermost sheet of paper P to get over the inclined surfaces 29*a* of the gate members 29 due to the pressing force of the second arm 35 (rotary member 33), it is possible to easily separate the uppermost sheet of paper P and the paper P underlying the uppermost sheet of paper P. As a result, when the uppermost sheet of paper P is fed, it is possible to efficiently suppress the double feed of the paper P underlying the uppermost sheet of paper P.

(2) In the auto feed device 13, since the displacement member is composed of the rotary member 33, it is possible to reduce the space necessary for displacing the displacement member between the pressing position and the non-pressing position, compared with the case where the displacement member is linearly reciprocated between the pressing position and the non-pressing position.

(3) The auto feed device 13 includes the coil spring 36 for energizing the rotary member 33 in the direction of its non-pressing position. Thus, when the front end of the uppermost sheet of paper P is engaged with the first arm 34, it is possible to rotate and displace the rotary member 33 from the non-pressing position to the pressing position against the energizing force of the coil spring 36 using the feeding force of the uppermost sheet of paper P. In addition, when the uppermost sheet of paper P is not engaged with the first arm 34, it is possible to rotate and displace the rotary member 33 from the pressing position to the non-pressing position by the energizing force of the coil spring 36.

(4) The rollers 34*a* and 35*a*, which rotate due to the feeding of the uppermost sheet of paper P, are provided in the contact portion of the first arm 34 with the uppermost sheet of paper P and the contact portion of the second arm 35 with the uppermost sheet of paper P. Thus, when the uppermost sheet of paper P is fed, the rotary member 33 is rotated and displaced from the non-pressing position to the pressing position. Accordingly, even when the first arm 34 and the second arm 35 are brought into contact with the uppermost sheet of paper P, it is possible to reduce the friction resistance force applied from the first arm 34 and the second arm 35 to the uppermost sheet of paper P. That is, even when the first arm 34 and the second arm 35 are brought into contact with the uppermost sheet of paper P, since the roller 34*a* and the roller 35*a* are rotated by the feeding of the uppermost sheet of paper P, it is possible to maintain the smooth feed state of the uppermost sheet of paper P without interfering the feed of the uppermost sheet of paper P.

(5) When the rotary member 33 is located at the non-pressing position, since the concave portion 21*c* into which the roller 34*a* of the first arm 34 is inserted is provided in the guide portion 21*a*, it is possible to increase the rotational range of the rotary member 33 by the depth of the concave portion 21*c*.

Modified Example

In addition, the above-described embodiment may be changed as follows.

At least one of the rollers 34*a* and 35*a* of the arms 34 and 35 may be omitted. In this case, the portions of the arms 34 and 35 with contact with the uppermost sheet of paper P preferably have a shape in which they easily slide on the uppermost sheet of paper P (for example, a drum shape, a spherical shape or a flat shape).

Instead of the coil spring 36, a rubber or torsion coil spring may be used as an energizing member.

A sensor for detecting that the front end of the uppermost sheet of paper P passes through the gap between the circumferential surface 23*a* of the separation portions 26 in the paper feed roller 23 and the gate members 29 may be provided, and an actuator which reciprocally moves between the pressing position and the non-pressing position based on the signal output from the sensor may be used as the displacement member instead of the rotary member 33.

A sensor may be provided for detecting that the front end of the uppermost sheet of paper P has passed through the gap between the circumferential surface 23*a* of the separation portions 26 of the paper feed roller 23 and the gate members 29, and a blower for blowing air so as to apply the pressing force along the stacked direction of the sheets of paper P to the paper P underlying the uppermost sheet of paper P before feeding over the uppermost sheet of paper P based on the signal output from the sensor may be used as the pressing force applying unit instead of the displacement member.

The concave portion 21*c* provided in the guide 21*a* may be omitted.

Instead of the paper feed roller 23, an endless transfer belt which circumferentially moves may be employed, and the paper feed operation may be performed by the circumferential movement of the endless transfer belt.

In the paper feed roller 23, the separation portions 26 may be omitted. In this case, the gate members 29 need to be configured to be in contact with the delivery portion 25.

In the paper feed roller 23, the delivery portion 25 and the separation portions 26 may be separately configured. In this case, the delivery portion 25 and the separation portions 26 need to be configured to be synchronously rotated by the rotation and the driving of the rotary shaft 24.

The number of rotary members 33 may be two or more.

The paper feed roller 23 may be configured in a circular shape in a side view.

In the paper feed roller 23, the separation portion 26 may be disposed on the center thereof in the axial direction and the delivery portions 25 may be disposed on both sides of the separation portion 26 in the axial direction.

The movement of the gate members 29 is not limited to rotation, and, for example, reciprocal movement may be used using a slider with a coil spring interposed therebetween.

Instead of the paper P, a plastic film may be used as a sheet member.

What is claimed is:

1. A feed device comprising:

a loading unit in which a plurality of sheet members is loaded in a stacked state;

a delivery member which performs a feed operation in a state in which a contact surface thereof is in contact with the uppermost sheet member of the sheet members loaded on the loading unit and delivers the sheet member in a feed direction using a feeding force, wherein the feeding force comprises a friction force generated between the contact surface and the uppermost sheet member;

a gate member which is configured to move in a direction to and from the contact surface of the delivery member and has an inclined surface with which the front end of the sheet member delivered by the delivery member collides with; and a gate energizing member which energizes the gate member in a direction approaching the contact surface of the delivery member, wherein, the uppermost sheet member is delivered by the delivery member such that the front end thereof collides with the inclined surface of the gate member, and a gap is formed through which only the uppermost sheet member passes between the delivery member and the gate member by moving the gate member against energizing force of the gate energizing member in the direction separating from the delivery member, and wherein a pressing force applying unit is included which applies a pressing force along a stacked direction of the sheet members at an upstream side of the inclined surface on a feed path of the sheet member to the sheet member underlying the uppermost sheet member over the uppermost sheet member, wherein the pressing force applying unit applies the pressing force to the sheet member underlying the uppermost sheet member only after a portion of the uppermost sheet member passes through the gap.

2. The feed device according to claim 1, wherein the pressing force applying unit includes a displacement member which is displaced between a pressing position where the sheet member underlying the uppermost sheet member is pressed and a non-pressing position where the sheet member is not pressed.

3. The feed device according to claim 1, wherein the pressing force applying unit includes a displacement member which is displaced between a pressing position where the sheet member underlying the uppermost sheet member is pressed and a non-pressing position where the sheet member is not pressed, wherein the displacement member includes a rotary member which is rotated and displaced between the pressing position and the non-pressing position.

4. The feed device according to claim 1, wherein the pressing force applying unit includes a displacement member which is displaced between a pressing position where the sheet member underlying the uppermost sheet member is pressed and a non-pressing position where the sheet member is not pressed, the displacement member includes a rotary member which is rotated and displaced between the pressing position and the non-pressing position, wherein the rotary member includes a first arm engaged with the sheet member at a downstream side of the inclined surface on the feed path of the sheet member at the non-pressing position, and a second arm applying pressing force to the sheet member underlying the uppermost sheet member before feeding at the pressing position.

5. The feed device according to claim 4, further comprising an energizing member for energizing the rotary member to the non-pressing position, wherein, when a portion of the uppermost sheet member is engaged with the first arm, the rotary member is rotated and displaced against the energizing force of the energizing member from the non-pressing position to the pressing position.

6. The feed device according to claim 4, wherein a roller, which is rotated by the feeding of the sheet member, is provided on at least one out of a contact portion of the first arm with the sheet member and a contact portion of the second arm with the sheet member.

7. A recording device comprising:

the feed device according to claim 1; and a recording unit which performs a recording process with respect to the sheet member fed by the feed device.

* * * * *